US008007405B2

(12) United States Patent
Burnfield et al.

(10) Patent No.: US 8,007,405 B2
(45) Date of Patent: Aug. 30, 2011

(54) REHABILITATION AND EXERCISE MACHINE

(75) Inventors: Judith M. Burnfield, Lincoln, NE (US); Yu Shu, Lincoln, NE (US); Adam P. Taylor, Lincoln, NE (US); Thad W. Buster, Gretna, NE (US); Carl A. Nelson, Lincoln, NE (US)

(73) Assignees: Madonna Rehabilitation Hospital, Lincoln, NE (US); Nutech Ventures, Lincoln, NE (US)

( * ) Notice: Subject to any disclaimer, the term of this patent is extended or adjusted under 35 U.S.C. 154(b) by 0 days.

(21) Appl. No.: 12/898,645

(22) Filed: Oct. 5, 2010

(65) Prior Publication Data

US 2011/0086742 A1 Apr. 14, 2011

Related U.S. Application Data

(60) Provisional application No. 61/250,718, filed on Oct. 12, 2009.

(51) Int. Cl.
*A63B 71/00* (2006.01)

(52) U.S. Cl. ..... 482/7; 482/8; 482/51; 482/52

(58) Field of Classification Search ..... 482/1–9, 482/51–53, 70, 900–902; 434/247
See application file for complete search history.

(56) References Cited

U.S. PATENT DOCUMENTS

| | | | | |
|---|---|---|---|---|
| 4,934,894 | A | 6/1990 | McIntosh | |
| 5,027,303 | A | 6/1991 | Witte | |
| 5,050,865 | A | 9/1991 | Augspurger | |
| 5,941,800 | A | 8/1999 | Laconis | |
| 6,001,071 | A | 12/1999 | Butler | |
| 6,220,991 | B1 | 4/2001 | Sellers | |
| 7,083,547 | B2 | 8/2006 | LaStayo | |
| 7,160,230 | B2 * | 1/2007 | Tremblay | 482/52 |
| 7,163,492 | B1 * | 1/2007 | Sotiriades | 482/51 |
| 7,354,384 | B2 | 4/2008 | Martin | |
| 7,485,080 | B1 * | 2/2009 | Chuang et al. | 482/142 |
| 2007/0298935 | A1 | 12/2007 | Badarneh | |

* cited by examiner

*Primary Examiner* — Glenn Richman
(74) *Attorney, Agent, or Firm* — Matt Catlett

(57) ABSTRACT

An improved rehabilitation and exercise machine is provided which allows a person with physical limitations, disabilities or chronic conditions to use the machine in order to rehabilitate their muscles, improve joint flexibility, and enhance cardiovascular fitness.

22 Claims, 9 Drawing Sheets

REHABILITATION AND EXERCISE MACHINE

CROSS-REFERENCE TO RELATED APPLICATIONS

This application claims priority to, and the benefit of, U.S. Application No. 61/250,718, filed Oct. 12, 2009, the specification of which is hereby incorporated by reference in its entirety.

FEDERALLY SPONSORED RESEARCH OR DEVELOPMENT

This invention was made with government support under Grant No. H133G070209 awarded by the National Institute on Disability and Rehabilitation Research (NIDRR). The government has certain rights in the invention.

FIELD OF INVENTION

The present invention relates to an improved rehabilitation and exercise machine, and more particularly to a rehabilitation and exercise machine that allows a person with physical limitations, disabilities, or chronic conditions to use the machine in order to rehabilitate their muscles, improve joint flexibility, and enhance cardiovascular fitness.

BACKGROUND

Approximately 53 million people living in the United States have some form of chronic condition or disability, of whom an estimated 15 million adults experience difficulty with walking. Numerous innovative therapies have been developed in the past to assist people in relearning to walk, move and improving their overall health. In this regard, body weight support treadmill training (BWSTT) was developed, that involves patients walking on a treadmill with their body weight partially supported by a body harness to reduce the load each leg must carry while walking. The extent of harness support is progressively decreased as strength and movement control improves. This technique has led to improvements in walking so that patients' outcomes exceed the gains arising from conventional therapy.

BWSTT, however, is not available in many settings because of the costs associated with using two to three therapists or clinicians and/or physical trainers to guide leg and trunk movements during training sessions. Additionally, the assistance can be very physically challenging for clinicians and poses a risk for injury. As a result, facilities and clinicians often settle for traditional over ground gait training therapy, hence preventing many patients from utilizing a promising intervention.

Recently, mechanized gait retraining devices (including robots) have emerged in part to address the challenges associated with BWSTT; however, these devices are primarily used in research-affiliated facilities and larger metropolitan areas. The expense of the devices (approximately $100,000 to $275,000) limits many clinics, hospitals and/or medical centers from purchasing the devices. Hence, individuals receiving care in more rural areas often lack access to a suitable rehabilitative technology.

Persons with disabilities and chronic medical conditions are at greater risk for developing additional medical problems than persons without disabilities, in part due to an inability to exercise at sufficiently challenging levels. Despite the large number of health and fitness centers available in most cities, many persons with activity limitations are unable to use these facilities. Common factors for the non-usage of the available facilities are inaccessible equipment and a lack of staff expertise in how to safely develop and implement a fitness programs for persons with chronic medical conditions. The lack of usable equipment is unfortunate because involvement in moderate levels of sustained exercise helps to prevent or delay the onset of other chronic conditions. Additionally, exercise prevents or reduces further functional declines associated with disuse and inactivity. One example of inadequate equipment is the elliptical trainer (also called a cross-trainer). These elliptical trainers guide the feet along a generally elliptical shaped curve to simulate the motions of walking, jogging and climbing. Numerous elliptical trainers have been disclosed in the patent literature. Rogers, Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Elliptical trainers in many cases provide inertia that assists in direction change of the pedals, making the exercise smooth and comfortable (see, e.g., U.S. Pat. No. 5,242,343 to Miller; U.S. Pat. No. 5,383,829 to Miller; U.S. Pat. No. 5,518,473 to Miller; U.S. Pat. No. 5,755,642 to Miller; U.S. Pat. No. 5,577,985 to Miller; U.S. Pat. No. 5,611,756 to Miller; U.S. Pat. No. 5,911,649 to Miller; U.S. Pat. No. 6,045,487 to Miller; U.S. Pat. No. 6,398,695 to Miller; U.S. Pat. No. 5,913,751 to Eschenbach; U.S. Pat. No. 5,916,064 to Eschenbach; U.S. Pat. No. 5,921,894 to Eschenbach; U.S. Pat. No. 5,993,359 to Eschenbach; U.S. Pat. No. 6,024,676 to Eschenbach; U.S. Pat. No. 6,042,512 to Eschenbach; U.S. Pat. No. 6,045,488 to Eschenbach; U.S. Pat. No. 6,077,196 to Eschenbach; U.S. Pat. No. 6,077,198 to Eschenbach; U.S. Pat. No. 6,090,013 to Eschenbach; U.S. Pat. No. 6,090,014 to Eschenbach; U.S. Pat. No. 6,142,915 to Eschenbach; U.S. Pat. No. 6,168,552 to Eschenbach; U.S. Pat. No. 6,210,305 to Eschenbach; U.S. Pat. No. 6,361,476 to Eschenbach; U.S. Pat. No. 6,409,632 to Eschenbach; U.S. Pat. No. 6,422,976 to Eschenbach; U.S. Pat. No. 6,422,977 to Eschenbach; U.S. Pat. No. 6,436,007 to Eschenbach; U.S. Pat. No. 6,440,042 to Eschenbach; U.S. Pat. No. 6,482,132 to Eschenbach; and U.S. Pat. No. 6,612,969 to Eschenbach).

Elliptical trainers are widely available in fitness centers as well as many healthcare and home settings. As currently designed, elliptical trainers resist movements for individuals with adequate strength who are attempting to further increase strength/endurance. They do not, yet, have the capacity to adapt to and assist movements for the people with weakness, joint pain, or movement initiation problems. The impact of this limitation is evident in individuals with physical limitations. Many who have a stroke, Parkinson's disease, arthritis, or total joint replacement (with disuse weakness) are unable to initiate or sustain exercise on elliptical trainers unless the clinician provides physical assistance to move the pedals. Once the required assistance is provided, many like the exercise due to its similarity to walking, the smoothness of movement, and opportunity for incorporating trunk and arms into the activity. The similarity to walking of movement patterns and muscle demands while exercising on an elliptical trainer suggests that beyond serving as an exercise tool, elliptical training can help people regain the strength and flexibility required for walking. For example, calf weakness, a common finding in older de-conditioned adults and individuals who have experienced a stroke, limits walking speed by reducing their ability to take steps of adequate length. The elliptical trainer requires calf muscle activity to stabilize the lower leg, particularly as the leg moves into a trailing limb posture. Joint and muscle tightness in persons with hip joint osteoarthritis or those who spend much of their day sitting in a wheelchair contributes to an excessively flexed (bent) posture while walking, which increases muscular demand and slows walking speed. Elliptical trainers with a moveable step length could be used therapeutically to provide a gentle repetitive stretch to tight muscles at the hip during training. A notable difference between elliptical training and walking is that both limbs stay in contact with the support surface during elliptical training, whereas with walking, there are periods when body weight is supported by only one leg. The constant contact of both feet with the support surface during elliptical training reduces the jarring forces associated with repeatedly loading the limb during each step of walking. This could be beneficial for individuals with painful joints.

The physically limited or rehabilitating users experience several difficulties while accessing and positioning themselves on an elliptical trainer. The difficulties are faced because of the potential muscle atrophy, joint stiffening, and general loss of balance and coordination that many rehabilitating individuals are challenged with. Therefore, at times it's difficult for the patients to maintain their posture and positioning on training devices like an elliptical trainer. In addition to the need for tools to help individuals with disabilities regain their walking function in the clinical setting, there also is a need for accessible and appropriately challenging exercise equipment to address cardiovascular and walking function following discharge from therapy programs.

SUMMARY OF THE INVENTION

Disclosed herein is an improved rehabilitation and exercise machine that may allow a person with physical limitations or disabilities to use the machine in order to rehabilitate their muscles, joint flexibility, and cardiovascular fitness. The machine may contain several features that allow for easier access, as well as a motor capable of assisting with or independently rotating the foot pedals and linkage system on the machine. Also disclosed is a new method for using the improved machine as part of a broader rehabilitative training program. The ultimate goal of the disclosed machine is to increase accessibility of traditional elliptical machines so that people with disabilities can engage in effective therapeutic exercise and gait programs in order to promote optimal health, quality of life, and maximum independence. The machine can be used in inpatient and outpatient settings, fitness centers and homes to help individuals improve their walking ability following a major medical event such as a stroke, brain injury, amputation or incomplete spinal cord injury, as well as to promote retention of walking skills in persons living with chronic conditions such as cerebral palsy, multiple sclerosis, Parkinson's disease, arthritis, total joint replacements, hip fractures or diabetes mellitus. Rehabilitation settings will benefit also as the invention will provide a less labor intensive tool for training and reduce the risk of cumulative injuries to employees that might arise from manual gait training techniques. The machine can also be used by individuals without disabilities as the design features do not prevent usage by individuals with normal movement function.

BRIEF DESCRIPTION OF THE FIGURES

The improved rehabilitation and exercise machine described herein may best be understood by reference to the following drawings, wherein.

Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of aspects and exemplary embodiments of the present invention.

DETAILED DESCRIPTION

The features of the improved rehabilitation and exercise machine disclosed and described herein, which are believed to be novel, are set forth with particularity in the appended claims. Description of the various embodiments detailed below is for understanding the invention. It will be understood that the invention is not limited to the particular embodiments described herein, but is capable of various modifications, rearrangements and substitutions, which will now become apparent to those skilled in the art without departing from the scope of the invention. Therefore, it is intended that the following claims cover all such modifications and changes that fall within the spirit and scope of the invention.

In alternative embodiments, system, process, and apparatus may include additional, fewer, or different components. In addition, each component may include additional modules, software, and interface devices that may be appended on requirement to operate the present invention in alternate embodiments.

The terms "a" or "an," as used herein, are defined as one or more rather than one. The term "another," as used herein, is defined as at least a second or more. The terms "including" and/or "having" as used herein, are defined as comprising (i.e., open transition). The term "coupled" or "operatively coupled," as used herein, is defined as connected, although not necessarily directly and not necessarily mechanically attached.

Figure 1:
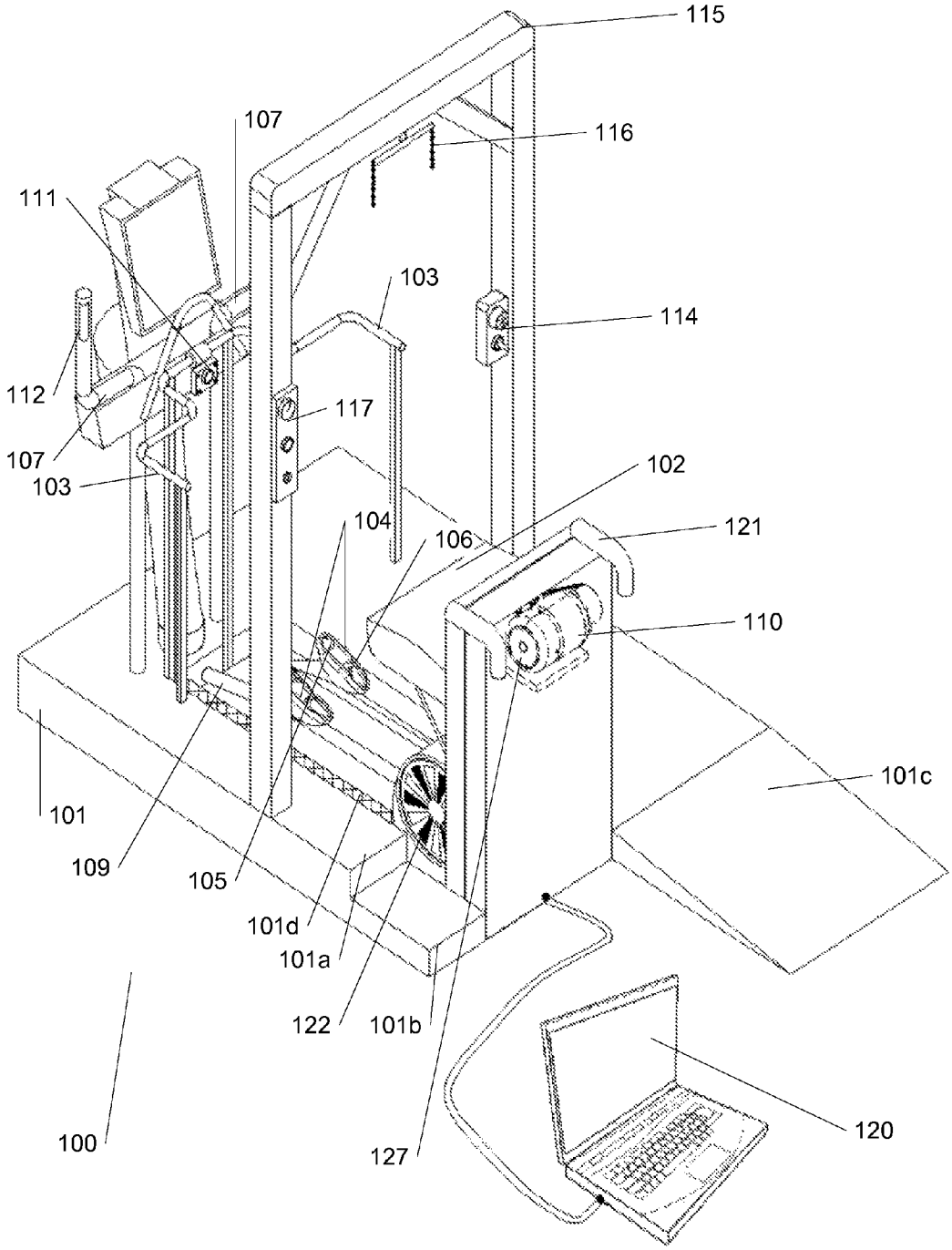
FIG. 1 illustrates an isometric view of the improved rehabilitation and exercise machine constructed according to the principles of the present invention.

Referring to FIG. 1, the improved rehabilitation and exercise machine 100 includes a standard rear drive elliptical machine. The standard rear drive elliptical machine includes a framework for supporting the machine to the floor. At the rear of the framework is attached a first and second crank arm (not shown). The first crank arm is connected to a first end of a first coupler link 109 having first and second ends, and the second crank arm is connected to a first end of a second coupler link 109 having first and second ends. A foot pedal 104 is present on each of the first and second coupler links 109. The second end of the first coupler link 109 is pivotally connected to a first moveable handle bar 107, and the second end of the second coupler link 109 is pivotally connected to a second moveable handle bar 107. A flywheel 122 with belt and pulley arrangement is operatively connected to each of the first and second crank arms. The force generated by the push and pull movement of the moveable handle bars 107 is transferred via the coupler links 109 to the crank arms and to the operatively connected flywheel 122. The transferred force actuates the rotational movement of the crank arms and the operatively connected flywheel 122. The rotational movement of the crank arms and the operatively connected flywheel 122 actuates the elliptical movement of the foot pedals 104.

FIG. 1 has several components that address the shortcomings in the standard rear-drive elliptical machine. The disclosed improved rehabilitation and exercise machine 100 allows persons with physical disabilities or limitations to access the machine 100. In one embodiment the user may be a patient, an individual, and/or a user of the disclosed rehabilitation and exercise machine.

The improved rehabilitation and exercise machine 100 may include a platform 101 configured around the framework of the machine 100, which may contains steps 101*a*, 101*b*, an inclined portion 101*c* in order to allow for wheelchair and ambulatory users to get onto the machine 100, and/or a ledge 101*d* alongside the edges of the platform 101, in order to safe guard a user and/or a clinician from sustaining any injury while the rehabilitation and exercise machine 100 is in operation. A pair of safety handles 121 may be included in the improved rehabilitation and exercise machine 100 in order to further assist a user to get onto the rehabilitation and exercise machine 100. The improved rehabilitation and exercise machine may further include a height-adjustable elevated platform 113. The improved rehabilitation and exercise machine 100 may further include a bench 102 coupled to the rear end of the machine 100, and a pair of height adjustable handrails 103 attached to the platform 101. The improved machine 100 may further include a motor and pulley assembly 110 to provide external force to the first and second crank arms via the flywheel 122. The improved machine may further include a stoppage mechanism 111 containing a push switch 111*a*, and/or a pull switch 111*b* including a connector 111*c* in order to stop the motor of the motor and pulley assembly 110. The improved rehabilitation and exercise machine may further include a remote control device 114 for allowing a clinician to control the motor of the motor and pulley assembly 110. The improved rehabilitation and exercise machine 100 may further include a body weight support system 115, which provides for the desired weight balance support to a user of the machine 100, a harness support 116, and a controlling mechanism 117 for controlling the operation of the body weight support system 115. The improved rehabilitation and exercise machine 100 may further include a micro-control unit 119 configured to receive and process data collected from different sensors located throughout the machine 100, and to transmit such data to a computing device 120 for decoding, display, storage and/or further processing. The micro-control unit 119, also called a microcontroller, may also be configured to receive and process instructions from a computing device 120 based on user input and to transmit such instructions to the motor of the motor and pulley assembly 110 to control the speed of the motor of the motor and pulley assembly 110.

In one embodiment, the steps 101*a*, and 101*b*, and/or the inclined portion 101*c* may span from the ground level to the elevation at which the pair of foot pedals 104 are located. The arrangement of steps 101*a*, and 101*b* and/or the inclined portion 101*c* may provide for the users, who previously had difficulty stepping onto the foot pedals 104 from the ground level, to now comfortably ascend until they are at an equal level with the foot pedals 104. In another embodiment, the ledge 101*d* prevents clinicians and/or users from having their foot trapped between the foot pedals 104 and the base 101.

Elliptical trainers known in the art can often be difficult to mount for users with muscle weakness, coordination problems, and/or balance deficits because the pedals are elevated substantially from the ground and are moveable. In one embodiment, an elevated bench 102 may be located at the rear end of the machine 100. The user may sit on the bench 102 before placing their feet on the pair of foot pedals 104. The user can then slide in a normal direction across the bench 102 until the user's body is centrally located over the machine 100. In one embodiment, the bench 102 is capable of being moved in a vertical or horizontal direction in order to accommodate users of different size and dimensions. The combination of the steps 101*a* and 101*b*, the inclined portion 101*c* and the bench 102 may provide for a user with physical disabilities or limitations to enter onto the machine 100. The bench 102 may further provide for the users with balance deficits and/or profound weakness to perform the training movement from a seated position. The elliptical training given in the seated position provides for the user to gain balance and strength to perform elliptical training movement in a standing position. In one embodiment, the size, dimension and location of the bench 102 may allow for the operation of the machine 100 by the users without any kind of disability. In one embodiment, the size, dimension and location of the bench 102 as well as the platform 101 including the steps 101*a*, and 101*b* and the inclined portion 101*c* may also provide for a clinician, physical therapist, occupational therapist, physiotherapist, physical trainer, recreational therapist, speech pathologist, fitness trainer, exercise kinesiologist, nurse, caretaker and/or doctor herein after referred to as clinician to either sit or stand behind the user during elliptical rotational movement exercises in order to further therapeutically facilitate normal movements of the legs, trunk, arms and other body parts of the user.

Figure 6:
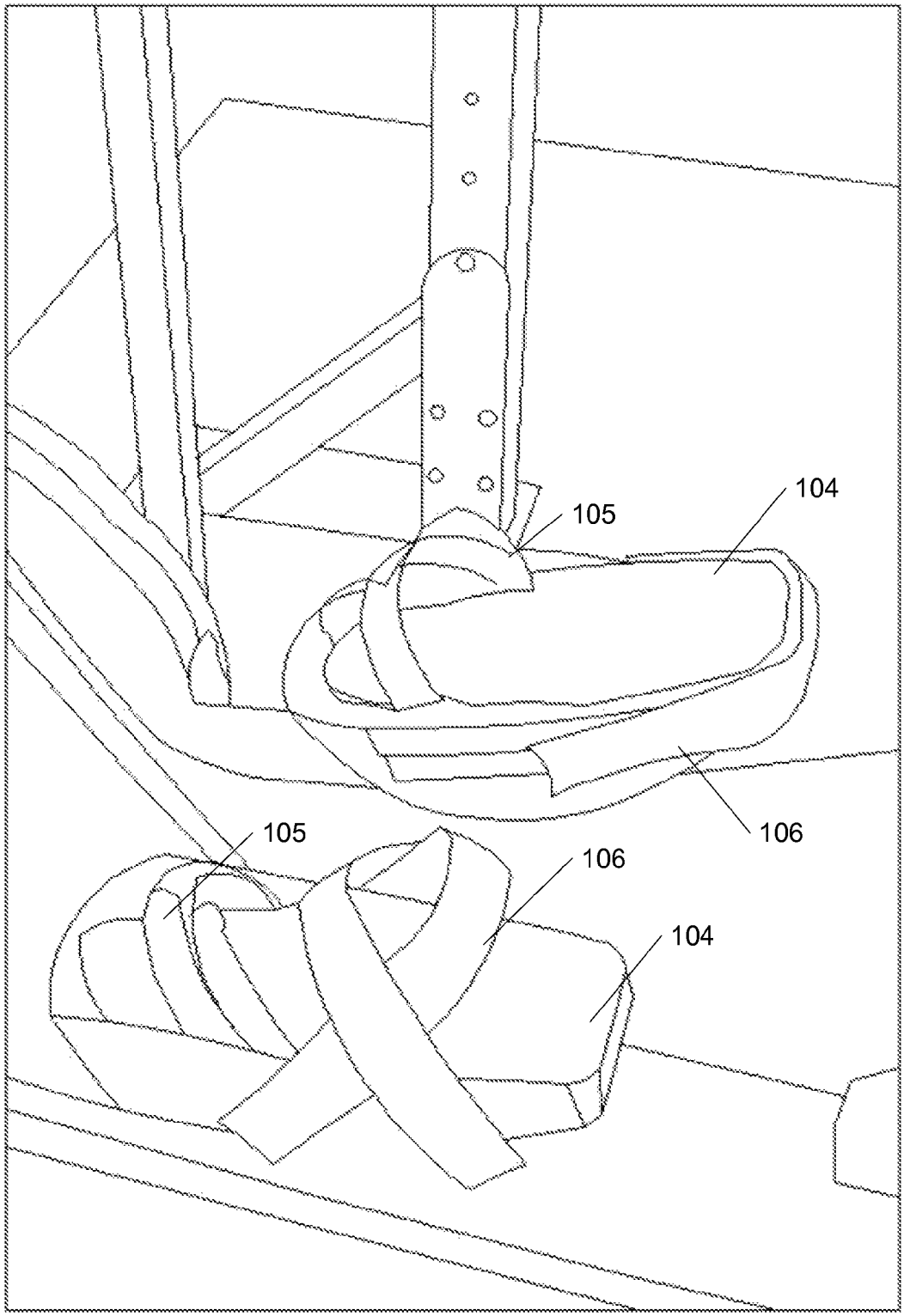
FIG. 6 illustrates the isometric view of a holster and a strap assembly of a pair of foot pedals connected to the improved rehabilitation and exercise machine of FIG. 1.

The foot pedals of elliptical trainers known in the art can often be difficult to maintain safe full foot contact for the physically limited or rehabilitating users. Abnormal muscle activity or tightness can cause the foot to lift or twist on the pedals, making use of the elliptical dangerous and inefficient. In one embodiment, the disclosed machine 100 may include a pair of foot pedals 104 as shown in FIG. 6 having a foot holster 105 that may extend over the top of the front portion of each of the foot pedals 104. In such a scenario, the user when placing each of the feet onto each of the foot pedals 104 may slide the foot under the provided holster 105 located in the front portion of the each of the foot pedals 104. The present arrangement of the holster 105 in each of the front portions of the foot pedals 104 may prevent the user's foot from unintentional movements mainly in the upward direction. Further, the holster 105 may provide for avoiding unforced rolling of the foot of the users off the pair of foot pedals 104. In one embodiment, the arrangement of the holster 105 may be constructed for, but is not limited to, individuals in this document referred to as users experiencing muscle imbalance or foot numbness. In one embodiment, the holster 105 can be made up of any material or a combination of materials but for understanding of the current embodiment the holster 105 is made up of plastic. The holster 105 can be made up of any alternative material or a combination of materials in order to keep the foot from lifting off the foot pedals 104. In addition, the disclosed machine 100 may further include a foot strap 106 that may be located on the rear portion of each of the foot pedals 104. The foot strap arrangement 106 may loop around the back of the user's heel, with the ends of the foot strap 106 attached to each of the foot pedals 104. In one embodiment, the holster 105 and the strap 106 arrangement may prevent the user's foot from sliding backwards and lifting out of the foot pedals 104. The strap 106, when not in operation, can be secured behind the rear of each of the pair of foot pedals 104. The current embodiment may use a hook and loop system to secure each strap 106 in the desired location, however, a person skilled in the art would appreciate that there are a variety of other ways to secure the strap while in operation or not in operation. Each of the foot pedals 104 further includes padding along the foot resting area of each of the foot pedals 104. The provided padding along the foot resting area of each of the foot pedals 104 helps prevents foot ulcers and pressure related injuries that may occur from the repetitive usage of any training equipment such as elliptical training equipment. In one embodiment, the padding on each of the pair of foot pedals 104 may be useful in case of users who have injuries or diseases and who are not able to detect pain that the ordinary users may experience.

Figure 2:
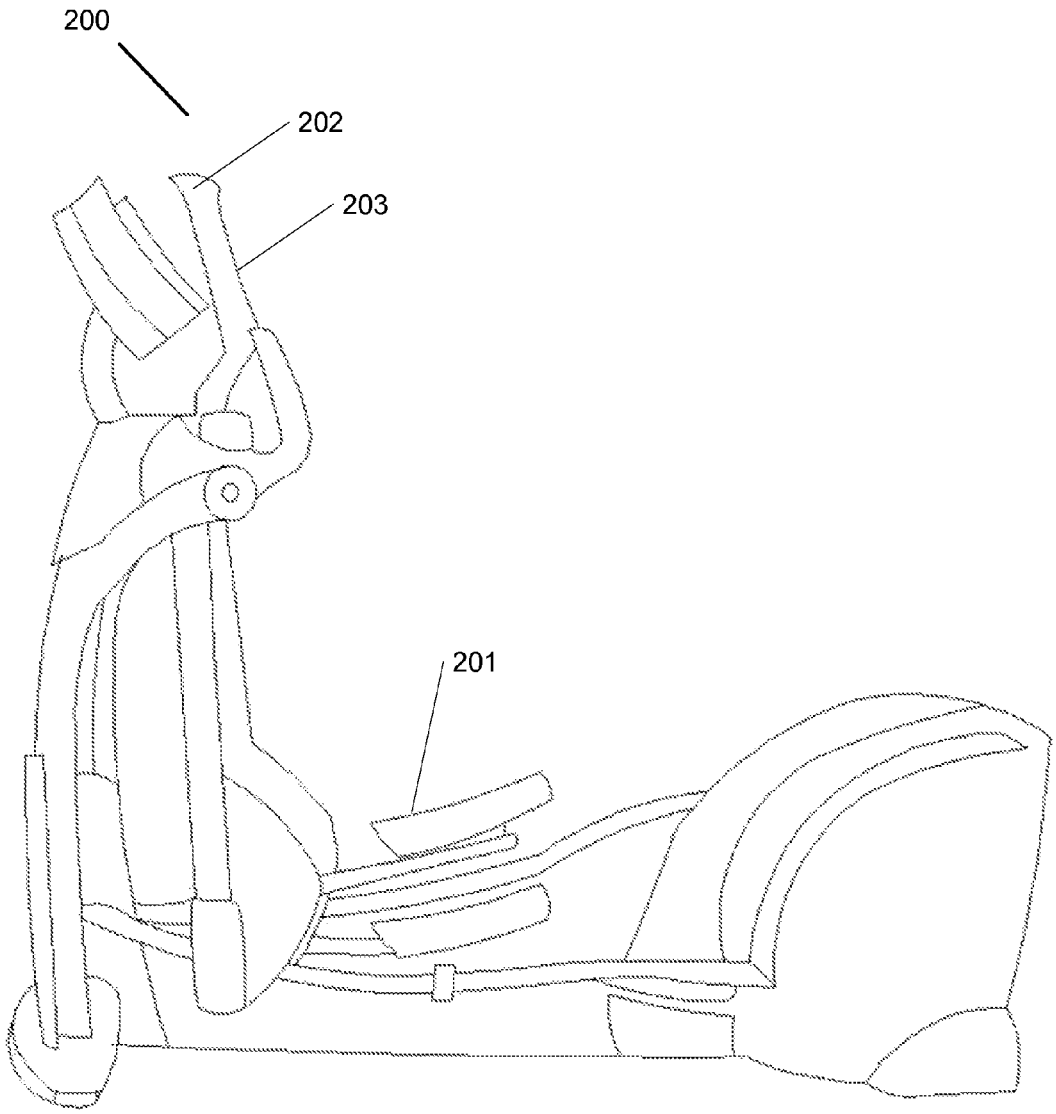
Fig. 2 (Prior Art)
FIG. 2 illustrates an isometric view of an elliptical machine already known in the art.
Figure 3:
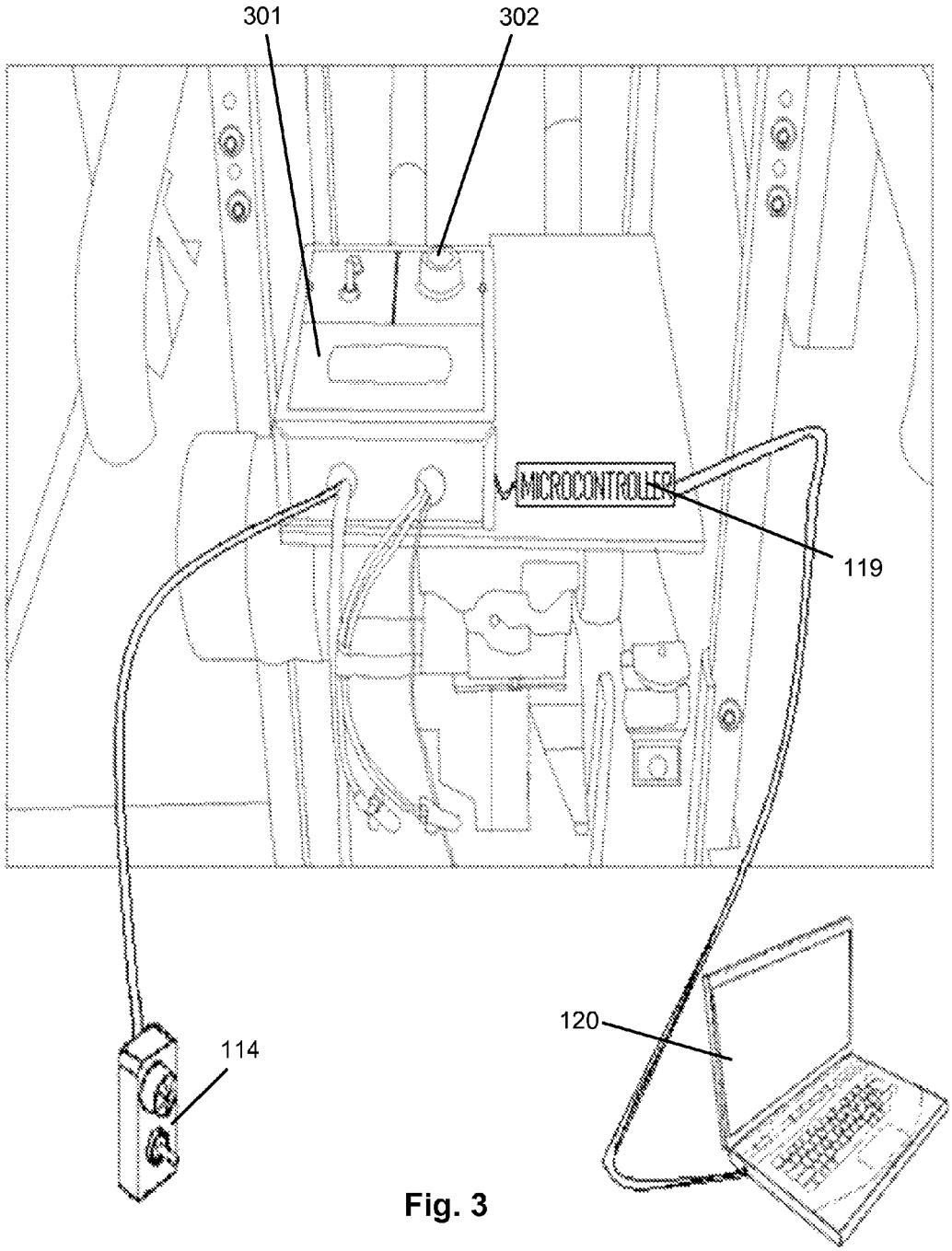
FIG. 3 illustrates a motor controller and micro-control unit for the improved rehabilitation and exercise machine of FIG. 1.
Figure 4:
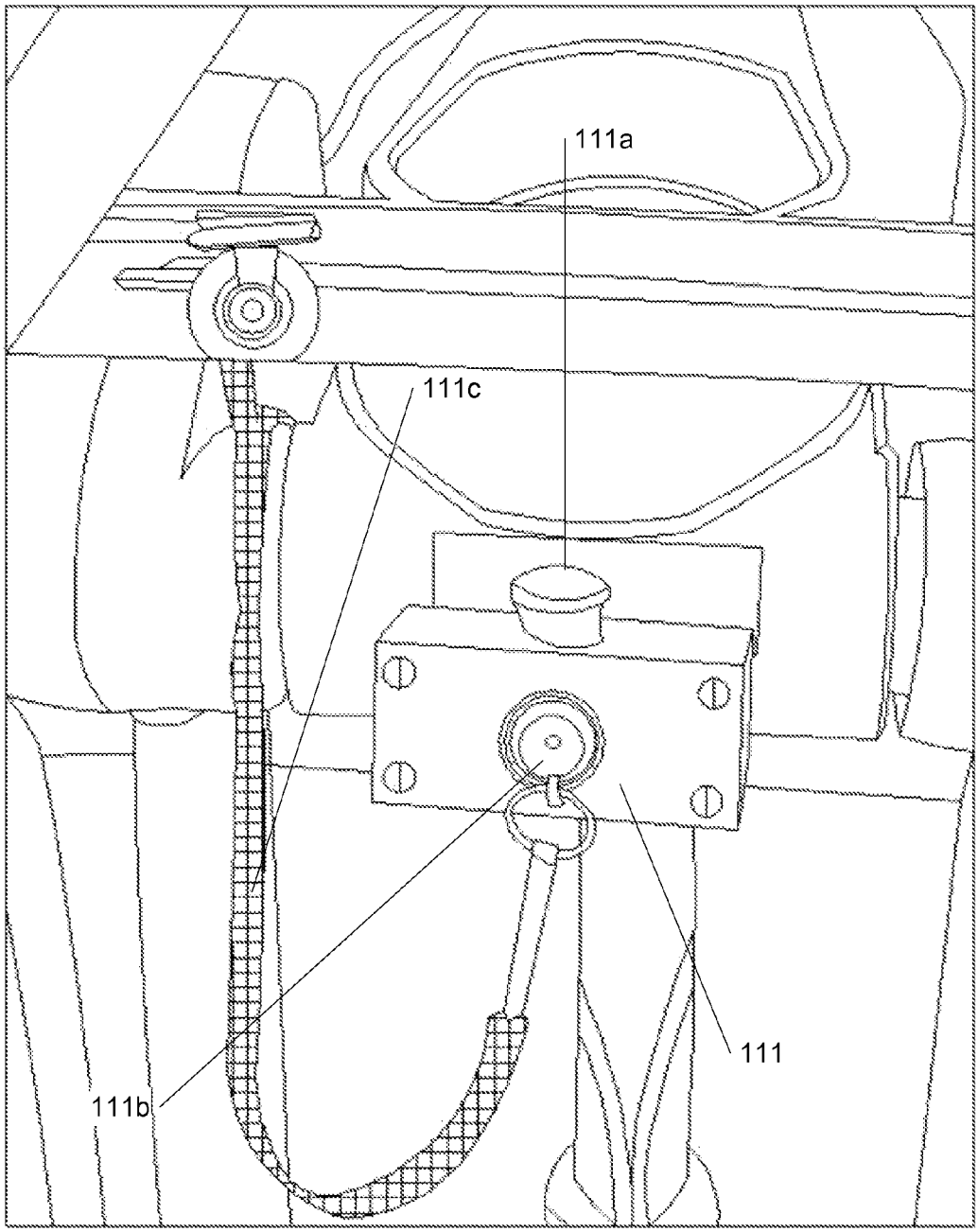
FIG. 4 illustrates a stoppage mechanism for the improved rehabilitation and exercise machine of FIG. 1.
Figure 5:
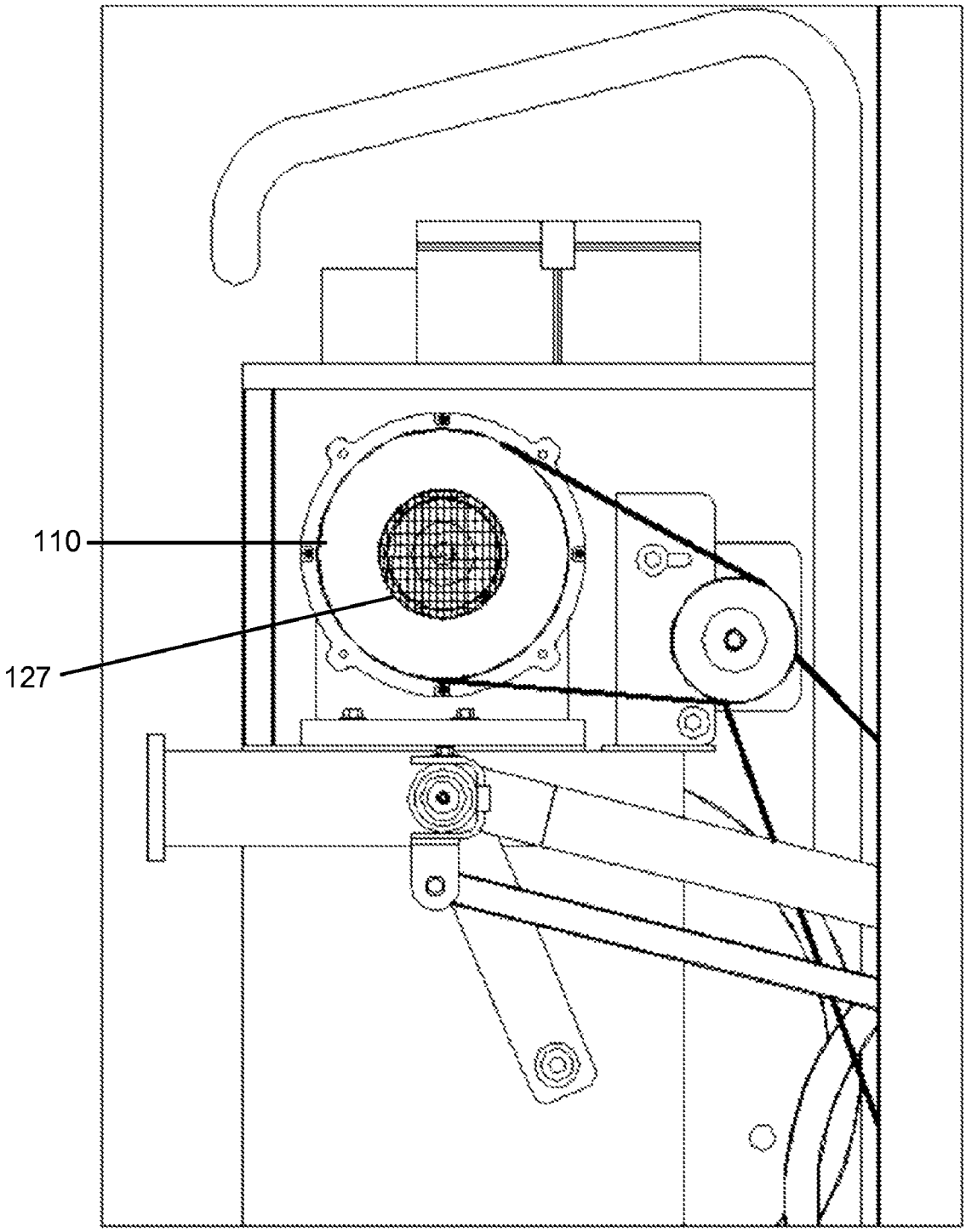
FIG. 5 illustrates a motor and pulley assembly and clutch for the improved rehabilitation and exercise machine of FIG. 1.

The standard rear-drive elliptical trainer 200 such as shown in FIG. 2 generally includes a pair of moveable handle bars 202 with hand grips 203 that may allow a user to grab the moveable handle bars 202 and push and pull on the bars 202, assisting with the elliptical rotational movement. The elliptical rotational movement may enable the user to train and move both the upper and lower limbs to achieve rotation of the footplates and linkage system 201 thereto. In one embodiment, the pair of moveable handle bars 202 may provide for the user to maintain the balance while operating upon the elliptical training equipment 200 such as the one disclosed in FIG. 2. However, the present arrangement and function of the pair of moveable handle bars 202 does not assist the users with physical limitations or disabilities to maintain a grip on the moving moveable handle bars 202, while simultaneously moving their legs and maintaining a foothold with respect to the footplate and linkage system 201. Moreover, users with physical limitations, disabilities and balance deficit would appreciate a supporting element with a wider platform of support.

Therefore, the disclosed improved rehabilitation and exercise machine 100 as shown in FIG. 1 may include a pair of height adjustable handrails 103 that may extend vertically upwards and/or horizontally forwards and/or backwards on either side of the machine 100. The pair of the height adjustable handrails 103 can be used to assist users of different body weight and height to maintain physical body balance while operating the machine 100 and/or while getting on and off of the machine 100. In one embodiment, the pair of height adjustable handrails 103 can be attached to the platform 101 of the machine 100. In another embodiment, the pair of height-adjustable handrails 103 can be attached directly to the framework of the machine 100.

Figure 9:
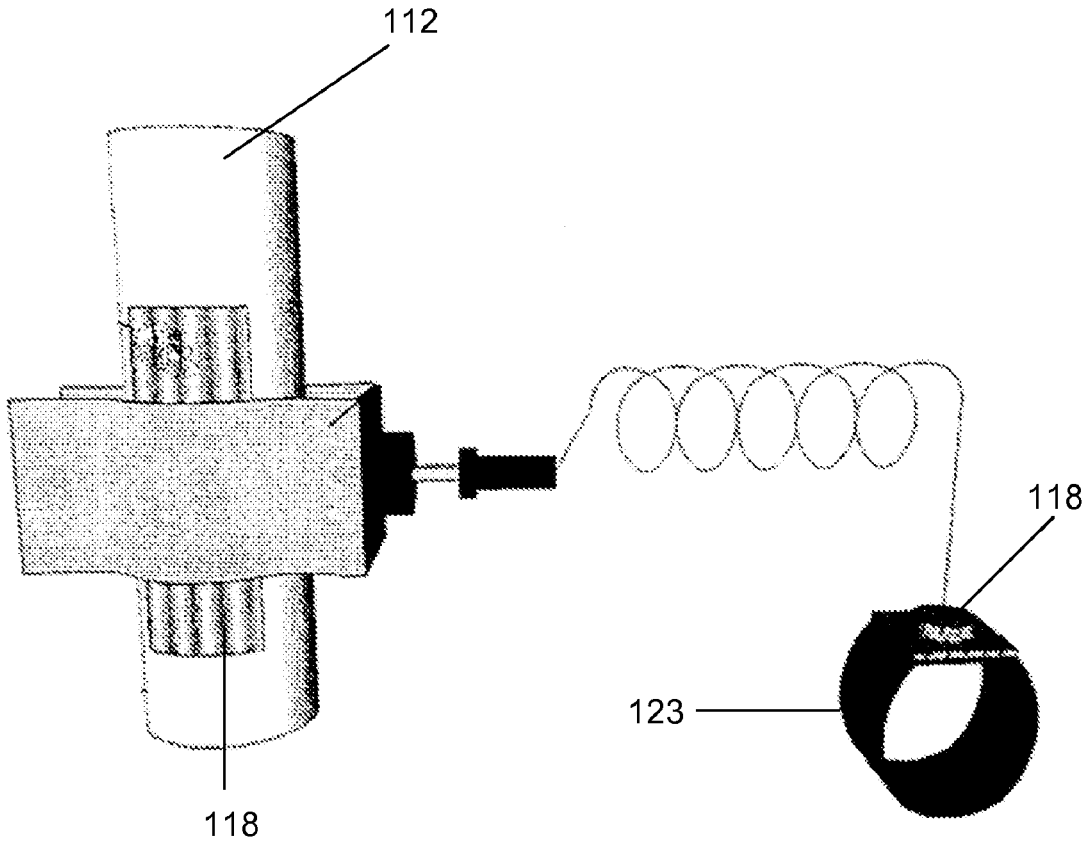
FIG. 9 illustrates a remote heart rate monitor for use in the improved rehabilitation and exercise machine 100 of FIG. 1.

The improved rehabilitation and exercise machine 100 is designed for rehabilitation and exercise of users with physical disabilities and balance deficits. One such disability may be a heart condition that leads to the need for monitoring heart rate in order to achieve safe and therapeutic exercise regime. Accordingly, the pair of moveable handle bars 107 with handgrips 112 preferably includes sensors that may measure a user's heart rate when the user is operating on the disclosed machine 100. In an ideal position, the hands of the user while operating on the machine may come in contact with the handgrips 112. The sensors are integrated into the handgrips 112 through a metal plate. The sensors generate electrical pulses coordinated with user's heart rate. The pulses are transferred in the form of electrical signal to a device for processing and display. However, some users with muscle weakness or movement control problems may not be able to maintain a constant grip required to record an accurate heart rate through the heart rate sensors in the handgrips 112. In this aspect, the disclosed machine 100 may include a remote heart rate monitor system as shown in FIG. 9 that may facilitate measurement of a user's heart rate when the hands of the user are not in contact with the handgrips 112. In a most preferred embodiment, the remote heart rate monitor system includes at least one heart rate sensor 118 integrated into an anti-static wrist strap 123. The heart rate sensor 118 in the wrist strap 123 is operatively connected to one end of a wire, the other end of which is connected to a standard banana plug. The banana plug is inserted into a binding post made of a conductive material, which binding post is attached to the base of a metal clamp. The metal clamp is configured in such a way that it contacts the heart rate sensors in the metal plate of the at least one handgrip 112 of the pair of handgrips 112. This remote heart rate monitor system permits measurement of the user's heart rate without having direct contact between the user's hand and at least one heart rate sensor 118 on at least one handgrip 112 of the pair of handgrips 112.

Figure 7:
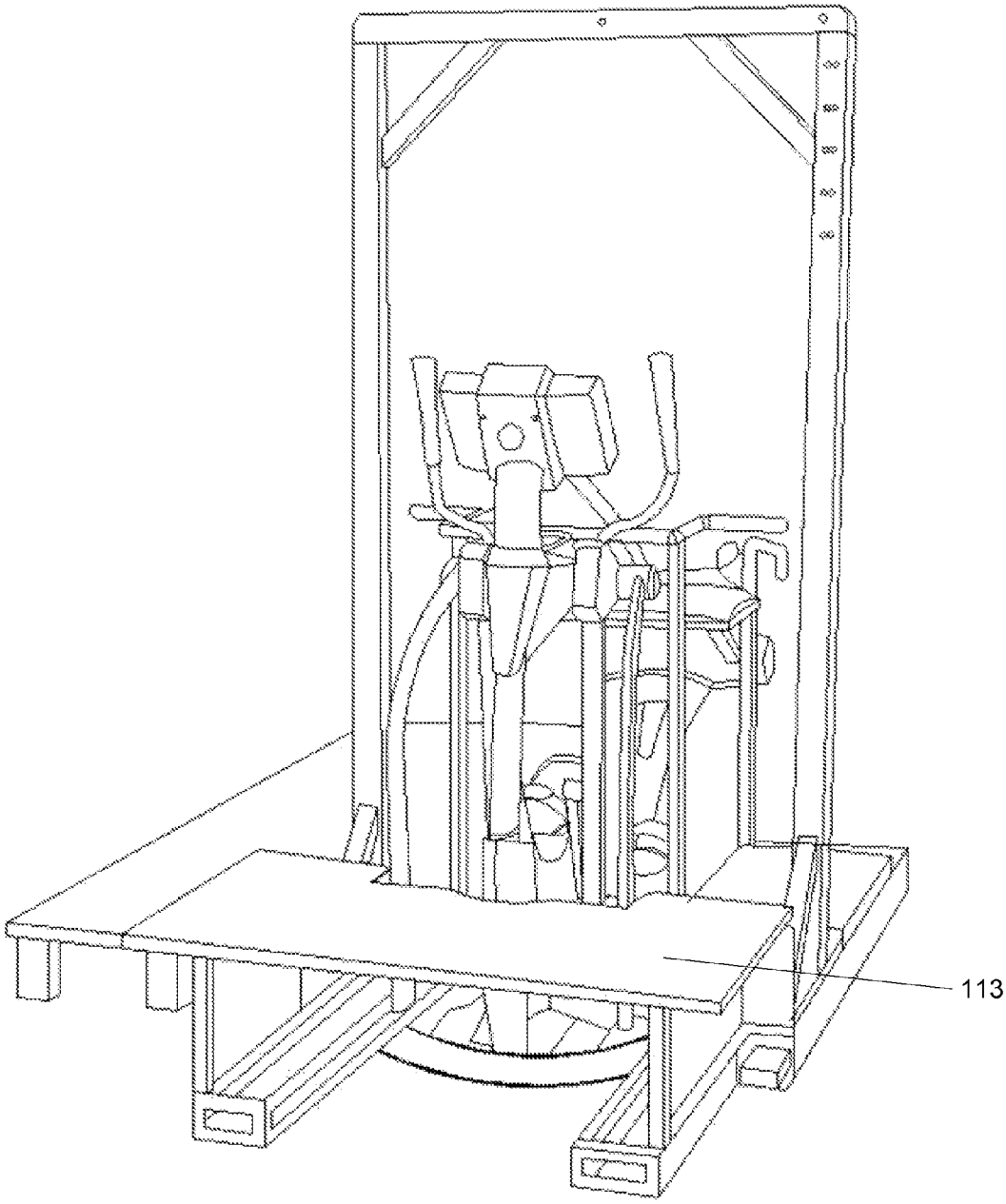
FIG. 7 is a right hand side elevational view with the height adjustable platform attached to the improved rehabilitation and exercise machine 100 of FIG. 1.

Users undergoing physical training or rehabilitation in conjunction with the improved rehabilitation and exercise machine 100 are often supervised and assisted by clinicians that instruct and supervise the exercise regimen of the users undergoing rehabilitation. In one embodiment, to assist these clinicians, the disclosed machine 100 may have a height-adjustable elevated platform 113 (FIG. 7) that may extend in a semi-circular direction around the front of the machine 100. Ideally the height of the moveable platform may enable the clinician to be at an eye level with the user. This enables the clinician to stand on the height-adjustable elevated platform 113 and either supervise the user with the use of the machine 100, or else work with the user on rehabilitation activities.

The standard rear-drive elliptical trainer 200 of FIG. 2 has a footplate and linkage system 201 that is resistive in nature. Further, the elliptical trainer 200 includes a pair of moveable handle bars 202 and a pair of hand grips 203 attached to the moveable handle bars 202. The pair of moveable handle bars 202 is linked to the footplate and linkage system 201, which includes a crank and flywheel. Elliptical rotational movement of the elliptical trainer 200 is actuated and sustained by the user exerting force through either the foot plate and linkage system 201 or the moveable handlebars 202. The foot plate and linkage system 201 requires an initial force to actuate the rotational movement of the elliptical training machine 200. However, it can often be difficult for users with physical disabilities, chronic conditions, and balance deficits undergoing rehabilitation to self initiate and/or sustain the elliptical rotational movement of the foot plate and linkage system 201 of the elliptical training machine 200.

Therefore, the improved rehabilitation and exercise machine 100 may provide for an assistive elliptical movement of the foot pedals 104 via a motor and pulley assembly 110. In this embodiment the motor and pulley assembly 110 is operatively connected to the rotatable flywheel 122, which is operatively connected to the first and second crank arms. In operation the motor of the motor and pulley assembly 110 provides external force permitting the flywheel 122 to rotate, thereby actuating the first and second crank arms to move the first and second coupler links 109, respectively, thereby actuating an identical rotational elliptical movement of the pair of foot pedals 104, each member of which pair of foot pedals 104 are attached to the first and second coupler links 109. The actuation of the elliptical rotational movement of the foot pedals 104 is independent of any user exerted forces. The motor and pulley assembly 110 can be located at any location on the machine 100. However, in a preferred embodiment, the motor and pulley assembly 110 is located at the rear end of the machine 100. The motor and pulley assembly 110 may facilitate the disclosed machine 100 to rotate indefinitely at rotational speeds ranging from 0 to 100 rotations per minute. In one embodiment, the motor and pulley assembly 110 includes an overrunning roller ramp clutch 127. The clutch 127 allows the user to train at a faster speed than the targeted speed of the motor of the motor and pulley assembly 110. In this situation, the motor and pulley assembly 110 is de-coupled from the flywheel 122 and provides no motor assistance to the user. In one embodiment, the motor and pulley assembly 110 may provide for the user irrespective of the degree of physical disability and/or balance deficits to initiate rehabilitation programs. Further, the motor and pulley assembly 110 may provide for simulation of walking movements and speeds without the user having to apply or exert the normal required force. In addition, the disclosed rehabilitation and exercise machine 100 may provide for significant therapeutic and rehabilitative value in the form of helping the users of the rehabilitation and exercise machine 100 to relearn the motions that different parts of the body must perform in order to walk and/or achieve required gait movement. Depending on the type and nature of injury or atrophied muscle that need rehabilitation, the users may experience difficulty at a specific instance in their walking strides, while experiencing ease of movement through the remainder of a walking stride. In order to provide assistance to a user in getting through the portion of his walking stride that the user is experiencing problems with, the motor of the motor and pulley assembly 110 may be adjusted to provide a required burst of force to the coupler links 109 via the operatively coupled flywheel 122 and first and second crank arms. The motor of the motor and pulley assembly 110 could be any motor known in the art capable of actuating movement of the first and second crank arms via the operatively coupled flywheel 122.

The disclosed improved rehabilitation and exercise machine 100 is suitable for use by users with and without physical disabilities and balance deficits. In one embodiment, the improved machine 100 may include a stoppage mechanism 111 that is capable of stopping the motor of the motor and pulley assembly 110. The stoppage mechanism 111 can be actuated in case of an emergency such as the user of the machine 100 meeting with an accident while operating upon the machine 100. The stoppage mechanism 111 can be actuated by the user by making contact with the stoppage switch 111*a* or 111*b*. In another embodiment, the stoppage mechanism 111 includes a push stoppage switch 111*a*. The push stoppage switch 111*a* can be actuated by punching the push stoppage switch 111*a*. In one embodiment, the stoppage mechanism 111 includes a pull stoppage switch 111*b*. The pull stoppage switch 111*b* includes a connector 111*c* having a first and a second portion. The first portion of the connector is attached to the pull stoppage switch 111*b* and the second portion of the connector is attached to the user. The motor of the motor and pulley assembly 110 is stopped if a required force is experienced by the connector 111*c* of the pull stoppage switch 111*b*. The stoppage mechanism 111 can be located in a region within the machine 100 in order to provide for the user of the machine 100 to easily reach the stoppage mechanism 111 in case of an emergency such as sudden increase in or abnormal heart rate and/or pulse rate, and in case of any injury to the user of the machine 100. A safety mechanism may be added so that if the stoppage mechanism 111 has been triggered, the motor of the motor and pulley assembly 110 cannot be re-started until the speed has been set to zero. This prevents a user from accidentally starting the machine at full-speed.

The speed of the motor of the motor and pulley assembly 110 can be controlled from a remote location by a third person, for example, a clinician from a remote control device 114. In one embodiment, the remote control device 114 can have a system to provide for the placement of the remote control device 114 at any location in and around the machine 100. In one embodiment, the remote control device 114 may include a magnetic system, which provides for the attachment of the device to any desired location within the machine 100 (as shown in FIG. 1).

Figure 8:
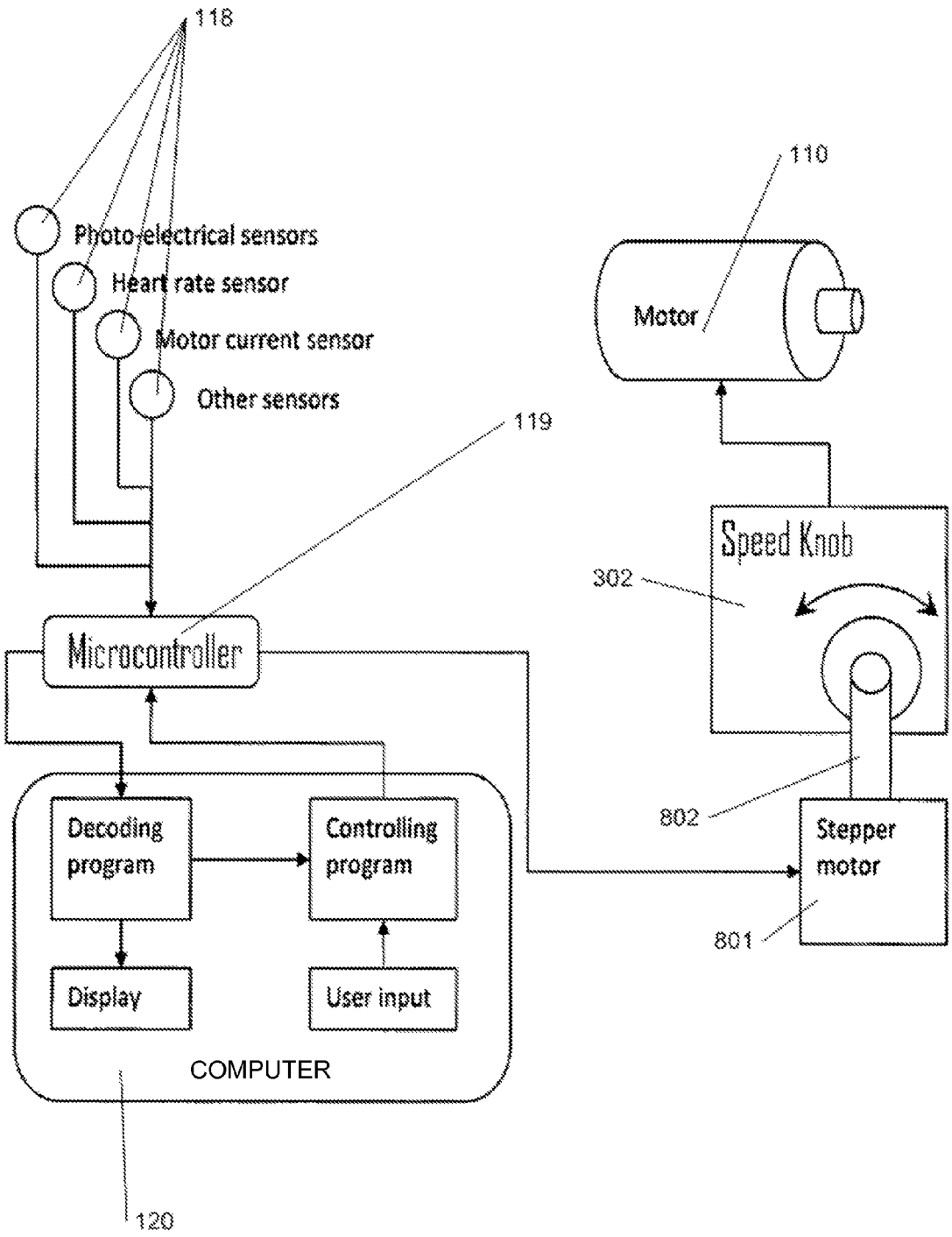
FIG. 8 illustrates the control system of the improved rehabilitation and exercise machine 100 of FIG. 1.

In one embodiment, the motor of the motor and pulley assembly 110 is controlled by a motor controller 301. The motor controller 301 includes a speed knob 302 for manually adjusting the speed of the motor. The speed of the motor may also be controlled by the micro-control unit 119. In this embodiment, an instruction signal is provided to the micro-control unit 119 from a computing device 120. As shown in FIG. 8, the signal is processed by the micro-control unit 119 and transmitted to a stepper motor 801 integrated into the motor controller 301. The stepper motor includes a shaft 802 which is connected to the speed knob 302. The received signal provides for the bi-directional rotation of the shaft 802 of the stepper motor 801, which rotates the speed knob 302 of the motor controller 301, resulting in an increase or decrease of the motor speed.

In one embodiment, the body weight support system 115 may provide for accommodating patients who have difficulty in supporting their own weight in an upright, gait, and/or standing position. In one embodiment, the body weight support system may include a harness support 116, which may provide for the desired support to the user for maintaining the standing, gait, and/or upright position while operating upon the machine 100. The harness support 116 can hold the user at a position or can be actuated in a vertical direction based on the weight balancing requirements of the user and/or the type of physical activity conducted by the user on the machine 100. In another embodiment, the body weight support system 115 may include a controlling mechanism 117, which controls and manages the operation of the body weight support system 115.

Referring again to FIG. 8, a micro-control unit 119 may be operatively coupled to a plurality of sensors 118 located throughout the machine 100. The plurality of sensors 118 are capable of capturing data and transmitting such data to the micro-control unit 119 for processing and transmission to the computing device 120 for further decoding, processing, display, and storage. Such plurality of sensors include heart rate sensors 118 located in the handgrips 112 of the moveable handle bars 107 and in the wrist strap 123 of the remote heart rate monitor system; photoelectric sensors 118 which are configured to face the flywheel 122, wherein the rim of the flywheel 122 has alternating light and dark stripes such that when the flywheel 124 rotates, the light/dark pattern, representing the rotational movement of the flywheel, is captured via the sensors 118; motor current sensors 118 which measure the current running through the motor of the motor and pulley assembly 110; and force transducer sensors 118 which may be located on the moveable handle bars 107 with handgrips 112 and the foot pedals 104 and which capture data based on how much force a user is applying to each of the moveable handle bars 107 via the handgrips 112 or the foot pedals 104. A timer may be included in the micro-control unit 119 for calculating speed-related variables (e.g., RPM) and for facilitating time-related operations. (e.g., 10 seconds bursts of higher speed training).

The micro-control unit 119 provides basic I/O functions between the sensors 118 and the computing device 120. The micro-control unit 119 receives data in the form of electrical signals from the sensors 118 and processes them to be recognized by the computing device 120. A decoding program present on the computing device 120 reads and decodes the electrical signals received from the micro-control unit 119 and converts them to actual numbers for display, or as data inputs into a controlling program running on the computing device 120. The controlling program may also receive external data inputs. Based on the data inputs, the computing device, through the controlling program, can provide instructions to the micro-control unit 119 for controlling the motor of the motor and pulley assembly 110 as previously described herein. In one embodiment, the control programs on the computing device 120 are written in Visual Basic 6.0 programming language. A single-board computer with programming language C such as a Jackrabbit BL1800, including a programmable processor and memory, allowing programs to be stored on the board, may be utilized with the micro-control unit 119, eliminating the use of a computing device 120.

The methods and systems described herein may transform physical and/or or intangible items from one state to another. The methods and systems described herein may also transform data representing physical and/or intangible items from one state to another.

The elements described and depicted herein, including the elements described in flow charts and block diagrams throughout the figures, imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, or any combination of these, and all such implementations may be within the scope of the present disclosure. Examples of such machines may include, but may not be limited to, personal digital assistants, laptops, personal computers, mobile phones, other handheld computing devices, medical equipment, wired or wireless communication devices, transducers, chips, calculators, satellites, tablet PCs, electronic books, gadgets, electronic devices, devices having artificial intelligence, computing devices, networking equipments, servers, and/or routers. Furthermore, the elements depicted in the flow chart and block diagrams or any other logical component may be implemented on a machine capable of executing program instructions. Thus, while the foregoing drawings and descriptions set forth functional aspects of the disclosed systems, no particular arrangement of software for implementing these functional aspects should be inferred from these descriptions unless explicitly stated or otherwise clear from the context. Similarly, it will be appreciated that the various steps identified and described above may be varied, and that the order of steps may be adapted to particular applications of the techniques disclosed herein. All such variations and modifications are intended to fall within the scope of this disclosure. As such, the depiction and/or description of an order for various steps should not be understood to require a particular order of execution for those steps, unless required by a particular application, or explicitly stated or otherwise clear from the context.

The methods and/or processes described above, and steps thereof, may be realized in hardware, software or any combination of hardware and software suitable for a particular application. The hardware may include a general purpose computer and/or dedicated computing device or specific computing device or particular aspect or component of a specific computing device. The processes may be realized in one or more microprocessors, microcontrollers, embedded microcontrollers, programmable digital signal processors or other programmable device, along with internal and/or external memory. The processes may also, or instead, be embodied in an application-specific integrated circuit, a programmable gate array, programmable array logic, or any other device or combination of devices that may be configured to process electronic signals. It will further be appreciated that one or more of the processes may be realized as a computer executable code capable of being executed on a machine-readable medium.

The computer executable code may be created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software, or any other machine capable of executing program instructions.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, the means for performing the steps associated with the processes described above may include any of the hardware and/or software described above. All such permutations and combinations are intended to fall within the scope of the present disclosure.

While the invention has been disclosed in connection with the preferred embodiments shown and described in detail, various modifications and improvements thereon will become readily apparent to those skilled in the art. Accordingly, the spirit and scope of the invention is not to be limited by the foregoing examples, but is to be understood in the broadest sense allowable by law.

WORKING EXAMPLES

Persons who have lost mobility due to injury and illness, such as brain or spinal cord injury, stroke, or degenerative diseases, have looked towards mechanized gait rehabilitation for restoration of healthy function. This process provides a means of repetitive motion that mimics normal gait, in order to regain the muscle strength and nervous system processing capabilities necessary for efficient walking. Various machines have been developed to promote normal gait movement and muscle activation patterns.

Treadmills have been used with partial-body-weight-support (PBWS) systems to accommodate patients who have difficulty supporting their own weight in a standing position. If the patient is unable to provide the strength to walk, physical therapists manually guide the lower limbs through a gait-like path. This process can create ergonomic issues both with the patient experiencing discomfort resulting from the PBWS harness and with the clinicians being exposed to musculoskeletal injury due to the awkward and uncomfortable positions they must repeatedly assume in order to provide assistance. Another concern is the kinematic accuracy of the actual gait cycle since the clinician can only help approximate the desired motions.

Elliptical machines differ from treadmills and robotic systems in that they offer patients an affordable, readily available device for therapeutic training. When minimal weakness is present, the coupling of the two legs and two arms frees health care professionals from the need to manually move the patient's lower limbs. In addition, stability is increased due to the ability to provide constant contact with both feet for the entirety of each movement cycle.

Unfortunately, when deficits in strength, balance or cardiovascular fitness are profound, many individuals find it difficult to access ellipticals. Once on the device, it is not uncommon for people with physical disabilities to find it difficult to initiate/sustain pedal movement.

To address the foregoing barriers, a modified elliptical trainer was developed. The main objective was to develop an affordable gait rehabilitation machine that could be used in rehabilitation settings, fitness facilities and patients' homes to help individuals with physical disabilities regain walking ability and cardiovascular fitness. The constraints for the design focused on overcoming the barriers inherent to existing rehabilitation machines: to provide affordable and accessible equipment while providing an easy to use product that avoids ergonomic and expertise issues for both patients and clinical staff.

In brief, the development phase focused on verifying the ability of an elliptical machine to provide correct gait mechanics and then on designing the necessary mechanical enhancements to increase accessibility, safety and usability of ellipticals by individuals with disabilities. Empirical comparisons of walking and elliptical training movement patterns were performed to identify an elliptical that closely simulated gait. Specifically, twenty individuals without disabilities walked over ground and exercised on four commercially available elliptical devices while 12-camera motion analysis recorded full body kinematics, surface electromyography documented lower extremity muscle activation patterns, and footswitch insoles defined foot-floor contact patterns and stride characteristics.

Analysis revealed that the SportsArt Fitness E870 (SportsArt Fitness, 19510 144th Ave NE, Suite A-1, Woodinville, Wash. 98072) elliptical demonstrated the greatest similarity in kinematic profiles to overground walking EMG analysis of muscle activation further confirmed the ability of the SportsArt to effectively simulate the muscular demands of walking.

The development and design process then focused on developing an integrated set of modifications to enable individuals with disabilities to safely and comfortably access the four ellipticals. Specifically, twenty adults with diverse medical conditions (including stroke, amputation, brain injury, arthritis, diabetes, Parkinson's disease, multiple sclerosis, hip fractures, cerebral palsy) and differing functional abilities evaluated the safety, accessibility, usability and comfort of four elliptical. Barriers and solutions to improve usage were systematically identified. Prototype modifications, including an integrated system of steps, railings, modified foot wells, a bench and a one-handed heart rate monitor, were developed. Participants re-assessed the modified ellipticals.

The integrated system notably reduced the barriers that participants had initially experienced when trying to use the unmodified ellipticals. Specifically, while at least one-quarter of participants required physical assistance to get on and off each elliptical prior to modifications, only one required this level of help after modifications. Before modifications, only one participant was able to mount each device independently, in notable contrast to the 30-40% of participants able to access each device independently following modification. Additionally, while nearly three quarters of participants (65-75%) required assistance from two or more examiners to safely get on/off each elliptical in its unmodified state, only 30-35% required this same number of assistants post-modification.

Before the ellipticals were modified, 15% to 35% of participants required help starting and maintaining pedal movement across the different ellipticals. While 5% to 25% still required assistance starting the pedals post-modification, participants were notably more independent in sustaining movement for short periods of time, as evidenced by only 0-15% requiring assistance to sustain pedal movement post-modification. However, the prolonged pedal movement required for a cardiovascular training program remained unobtainable for many.

Compared to pre-modification, participants' post-modification elliptical ratings were significantly higher for safety (54.7% increase in visual analog score), comfort (42.9% higher), ability to achieve a good workout (23.4% greater) and overall usability of the ellipticals (23.7% increase). Participants' greater efficacy reflects the impact of the integrated modification package on reducing barriers to usage.

Next, the design process focused on providing an assistive force instead of the resistive force that is inherent to ellipticals. An adjustable motor control was integrated to assist the patient to perform repetitive cycles simulating normal gait while allowing varying degrees of patient effort. A detailed feedback system was then developed and utilized with computer-based data collection and analysis to develop clinical guidelines for using the system.

The specific objective of applying a motor to the existing elliptical machine was to provide the external torque required to initiate and sustain cyclic movement on the elliptical that could not be accomplished by individuals with weakness or motor control deficits. A maximum controlled gait speed target of 60 rpm was set while controlling torque and satisfying space constraints.

Initially it was desired to design all the modifications so that they could be located within the existing housing of the elliptical machine. This was to be accomplished by relocating the integrated 12-V battery and using this space for mounting the motor and associated components. A 380-W (½ hp) DC brushed motor was chosen for satisfying the needs of a large torque and a limited space to place the motor on the existing machine. A Cricket microcontroller which had both analog and digital inputs and a speed control (pulse width modulation or PWM) was initially targeted for use in controlling the motor. The main task of the microcontroller was to read an encoder signal and two potentiometer analog signals to control speed and maintain torque limits. The Cricket microcontroller was chosen because of its simplicity. However, the half H-bridge for controlling speeds on the microcontroller (power metering and amplification) could not handle the level of current required by the motor. Thus, an independent bidirectional digital PWM motor speed controller was selected, and its I/O necessitated a change of microcontroller in order to accommodate the increased quantity and variety of data channels. The relatively straightforward architecture and programming of a Basic Stamp II microcontroller allowed the device to be connected to a quadrature decoder and an AD board, sending input signals to the motor driver and taking input from a tachometer signal already integrated on the elliptical machine. Lab experiments using a motor with an integrated encoder were successful and showed that the BS-II could read the encoder signal and control the desired speed. However, once the microcontroller was connected with the elliptical machine, the machine's integrated electronics interfered with the encoder signal and prevented correct control implementation on the BS-II. Therefore, an analog mode for directly controlling the motor driver was considered next.

The analog mode on the speed controller was used with a potentiometer to control torque. This solution proved that it could produce torque to help subjects cycle on the machine, yet did not provide enough torque to initiate patient movement from a full stop. This was due to the motor characteristics (designed for optimal performance at high-speed rather than low-speed conditions).

The need for higher starting torque led to an easing of the space restrictions; it was decided to use a larger motor and design a new housing to enclose it. Thus the next design iteration involved a 90-V gear-motor with a manufacturer-matched speed controller. This could control the speed well and provided sufficient torque. However, because it was geared down, it did not provide enough speed to meet the target of 60 output rpm, even after changing the ratio of pulley diameters used to couple the motor to the elliptical machine. An overall maximum system speed near 10 rpm was achieved with this gear-motor. Another limitation of this particular motor was the amount of resistance encountered; with the speed controller turned off, the machine was difficult to use in its passive mode due to the gearbox.

The motor was then changed to a ¾ hp motor using the same speed controller. This design could control the speed well, especially at higher speeds. Adjusting pulley diameters resulted in a maximum speed in excess of the target value of 60 rpm. An overrunning roller ramp clutch also was added to allow the user to drive the machine faster than the controllers target speed if desired. This modification provided an important enhancement to the overall system functionality.

The pulley system was designed to couple the motor to the elliptical machine through its generator, which charges a battery to power the device's integrated electronics. The pulleys were designed with a slip-fit, set-screw attachment onto the outside of the existing generator pulley, and a keyed attachment to the motor shaft. The diameters were constrained due to the spacing between the motor and generator shaft axes. Within this range, the diameters were chosen as 6.0 and 10.3 cm (driven and driving, respectively) in order to achieve the output target speed value of 60 rpm.

A V-belt pulley system was first employed in the transmission. This was a low-cost solution that allowed adjustability through the use of modular V-belt links. It also was insensitive to any misalignment. However, the difference in frictional losses as compared with flat-belt systems led towards the adoption of a flat-belt transmission. The introduction of a flat belt used with custom-specified crowned pulleys, using the same effective diameters as the V-belt system, did in fact provide superior output torque in clinical evaluation for the same speed settings, and this became the specification in the final design.

Dynamic evaluation of the system's alterations demonstrates the ability of the system to propel a person from zero to 60 strides per minute while maintaining the foot pedals in the desired path. Limitations imposed include the original elliptical machine's maximum allowable user weight of 300 lbs without the ability to provide any path-specific assistive force.

The SportsArt Fitness E870 uses an interesting variation of the crank-rocker mechanism to achieve good motion biofidelity and maintain adjustability. As in many ellipticals, the crank is located in the rear and is tied to the pivoting handles (rocker) by a long coupler link. In the simple crank-rocker elliptical, the foot pedals are located on the coupler. In this variation, an additional coupler-type link actually participates in a small-displacement slider-based sublinkage, with the rocker of the main linkage anchoring the sub-linkage. This secondary coupler has a curved contour, and the foot pedals are on a roller-follower moving over a small portion of this curved contour. This fine-tunes the motion path and allows subtle adjustments to ankle motion throughout the movement cycle. A flywheel is attached to the rear crank via a set of belts and pulleys. The elliptical system includes a secondary linkage that adjusts stride length (by changing the length of the rocker) and stretches the shape of the pedal path from that of the simpler four-bar elliptical designs. Damping (thus workout) is controlled in the non-modified system by an alternator attached to the flywheel. In the assistive configuration, the alternator load is maintained at its minimum, only charging the on-board battery to run the system electronics.

A safety switch was used in the system to ensure that power to the motor could be shut off quickly if needed. Initially, a custom-designed switch involving a pair of opposing spring contact plates was developed and implemented in the prototypes. First, a triangular base was made from plastic in order to provide a platform for two conductive strips. The strips were mounted on each side of the triangular base such that they met at the apex of the triangle. Bends in the strips allowed a plastic card to be inserted and open the circuit between them. Wire leads were connected to an interrupt circuit on the motor controller. Insertion of a small plastic card between the connecting conductive strips opened the circuit and allowed the motor-drive to receive power. Second, an aluminum bracket was designed and fabricated in order to locate the safety switch close to the user so that the plastic card could be worn on a lanyard, similar to safety keys found in home exercise equipment. Third, a cover was rapid prototyped in plastic in order to protect the metal contacts from accidental short circuit events. This was a simple boxed enclosure with a slot in the top where the card could be inserted in order to open the circuit. The cover included two mounting tabs on either side for attachment to the safety switch mount.

One desirable safety feature which was not achieved by this design was preventing the machine from being turned on with the speed setting well above zero. Therefore, a more robust relay-based safety circuit was designed, allowing any break in the interrupt circuit to cause the main circuit to open until the potentiometer was returned to a zero position. Because the system shutdown was achieved by an open circuit rather than closure of an interrupt as in the previous design, the lanyard design could be changed to a simpler magnetic attachment. This magnetic component, when attached, closes the circuit, enabling the motor. Detachment of the magnet caused the motor circuit to open and shuts down power. Testing the safety switch showed that the magnet was successfully removed from the safety switch platform with application of an appropriate level of tensile force in the lanyard with a wide range of pull directions.

The subsequent design and refinement process focused on evaluating the impact of the integrated set of modifications on the ability of individuals with and without disabilities to elliptical train. The goal was to not only ensure increased usability by individuals with disabilities, but also to ensure that the modifications did not hinder use by non-disabled. Twenty adults participated in this phase of the testing. Ten had chronic diseases or physical disabilities (e.g., stroke, diabetes, multiple sclerosis, traumatic brain injury, amputation, or arthritis), while ten were free from known physical disability. All were able to walk independently. Six required use of an assistive device (e.g., a cane, walker, unilateral/bilateral ankle-foot orthoses). One individual used an above-knee prosthesis and one required both an above-knee and below-knee prosthesis.

Given the previous findings regarding the similarity of joint and muscle demands while training on the SportsArt Fitness E870 elliptical trainer to those occurring during walking, this elliptical was selected to modify with the fully integrated system that included two staircases, a bench, modified foot pedals, railings, a one-handed heart rate monitor, a motor, a pulley, and the clutch and speed control system. Participants used both the modified and unmodified system and provided feedback regarding the impact of the modifications. The steps improved the ability of 100% of the individuals with disabilities to use the device and 60% of those without a disability. Similarly, the modified foot pedal system improved usage in 100% of those with a disability, and 40% of the nondisabled, while hindering usage by only 10% of the nondisabled. A subsequent pedal design was developed that allowed for greater adjustability of the forefoot and heel strapping mechanisms to more effectively accommodate the needs of different users. The motor improved the ability of 90% of those with a disability to use the elliptical and 60% of those without a disability. One participant with a disability indicated that the motor hindered equipment use. The railings improved use in 80% of disabled users and 50% of non-disabled users, while hindering usage in only one disabled user due to their abdominal girth. A subsequent design allowed for greater handrail adjustability in the horizontal and vertical directions to accommodate clients with differing abdominal girths and body heights, respectively. The bench improved the ability of 70% of those with a disability and 30% of those without a disability to use the ellipticals, while hindering usage in none. The need for an expanded range of heights was identified during this phase of evaluation to accommodate the needs of clients with differing strength capabilities and heights. The one-handed heart rate monitor benefited 40% of the disabled users and 20% of non-disabled users, while hindering usage of none. The select impact of the heart rate monitor was expected as not all participants had impairments in their upper extremities that would necessitate use of the one-handed heart rate monitor.

The integrated set of modifications significantly improved perceptions of safety when averaged between the two groups (VAS, pre-modification=7.0 vs. post-modification=8.8; p=0.005), primarily due to a significant increase from pre to post modification in those with a disability (pre=4.6, post=8.3) compared to the minimal gain posted in those without a disability (pre=9.3, post=9.4; interaction p=0.006). The modifications significantly improved perceptions of comfort when averaged between groups (VAS, pre-modification=7.1 vs. post-modification=8.5; p=0.045). Those with a disability experienced a significant increase in comfort from pre to post modification (pre=5.7, post=8.6) compared to the minimal decrease identified in individuals without a disability after the modification (pre=8.5, post=8.3; interaction p=0.028). The modifications significantly improved perceptions of usability when averaged between groups (VAS, pre-modification=7.0 vs. post-modification=9.1; p=0.010). Those with a disability perceived of a greater increase in usability from pre to post modification (pre=5.6, post=9.5) compared to the more modest increase identified in individuals without a disability (pre=8.3, post=8.9; interaction p=0.032).

Collectively, the integrated set of modifications reduced barriers that individuals with physical disabilities experienced when trying to use the elliptical as well as improving perceptions of usability by individuals without disabilities. This stage of the design process reinforced that implementation of the integrated system could enable a greater number of individuals to use the device without hindering usage by the "traditional" non-disabled user.

The fully integrated system was subsequently tested in three environments with over 30 individuals with disabilities to refine treatment guidelines and maximize functionality. Specifically, ten inpatients participating in intensive inpatient stroke rehabilitation and one young woman recovering from a severe brain injury due to being submerged under water for over 30 minutes trained on the integrated modified elliptical system. Ramp access was added to the platform system as the many of the users were not yet able to walk. The ramp increased the clinicians' capacity to help clients on and off of the device and reduced the risk of injury associated with transferring severely disabled clients onto the device. In addition, the platforms were modified to enable integration with a commercially available body weight support system as many clients were unable to independently support their body weight given their profound weakness and balance deficits. Also, a platform was added at the front of the device to enable clinicians to combine speech and occupational therapy activities with functional and cardiovascular training activities already being performed using the modified elliptical. The resulting dual-task training opportunities better prepared patients for the challenges of the "real world" in which one must "walk and talk."

Also, ten individuals receiving outpatient physical therapy for a variety of conditions including hemiplegia, brain stem stroke, incomplete spinal cord injury, multiple sclerosis, Parkinson's disease, and degenerative joint disease each participated in up to 12 sessions on the modified elliptical trainer. The final testing environment was a fitness facility. Fitness trainers incorporated the modified elliptical system and therapeutic program into their fitness training for clients with physical disabilities arising from a variety of chronic and/or progressive neurologic and orthopedic conditions. The modular system easily adapted to accommodate the space limitations of the outpatient clinic and fitness settings, while also ensuring accessibility and usability by individuals with diverse medical conditions. Feedback from clinicians, fitness trainers, patients and clients was positive, with a desire to "keep" the device once formal testing ended.

Collectively, these ergonomic, mechanical and electronic development activities provided a completely finished, ready-to-use gait rehabilitation machine with demonstrated clinical results.

We claim:

1. A rehabilitation and exercise machine comprising:

a framework configured to be supported by the floor;

a first and second crank arm, wherein said first and second crank arms are operatively connected to said framework and further operatively connected to a rotatable flywheel;

a first and second moveable handle bar;

a first and second foot pedal;

a motor and pulley assembly, wherein said motor and pulley assembly is operatively connected to said rotatable flywheel and is configured to actuate said rotatable flywheel, and wherein said motor and pulley assembly is capable of operating at variable speeds, thereby actuating said rotatable flywheel at variable speeds;

a first and second coupler link, wherein each of said first and second coupler links has a first end and a second end, wherein said first end of said first coupler link is operatively connected to said first crank arm and said second end of said first coupler link is operatively connected to said first moveable handle bar, wherein said first end of said second coupler link is operatively connected to said second crank arm and said second end of said second coupler link is operatively connected to said second moveable handlebar, and wherein said first foot pedal is operatively connected to said first coupler link via a secondary coupler, and wherein said second foot pedal is operatively connected to said second coupler link;

a motor controller with speed knob, wherein said motor controller is operatively connected to said motor and pulley assembly, and wherein said motor controller is capable of controlling the variable speed of said motor and pulley assembly.

2. The rehabilitation and exercise machine of claim 1, further comprising a micro-control unit, wherein said micro-control unit is operatively connected to said motor controller, and wherein said micro-control unit is operative to control said speed knob of said motor controller.

3. The rehabilitation and exercise machine of claim 1, wherein said motor of said motor and pulley assembly includes an overrunning clutch, said overrunning clutch permitting for de-coupling of the motor and pulley assembly from said rotatable flywheel.

4. The rehabilitation and exercise machine of claim 1, further comprising a platform configured around said framework, wherein said platform includes at least one step, wherein said at least one step assists a user of said machine to mount said user's feet on said foot pedals.

5. The rehabilitation and exercise machine of claim 4, wherein said platform further includes at least one inclined area, wherein said at least one inclined area assists a user of said machine to place said user's feet on said foot pedals.

6. The rehabilitation and exercise machine of claim 4, wherein said platform further includes adjustable handrails attached to said platform.

7. The rehabilitation and exercise machine of claim 5, wherein said platform further includes adjustable handrails attached to said platform.

8. The rehabilitation and exercise machine of claim 1, further comprising an adjustable bench coupled to said machine permitting a user of said machine to sit on said bench while using said machine.

9. The rehabilitation and exercise machine of claim 2, further comprising a computing device, wherein said micro-control unit is connected to said computing device and includes means for transmitting computer-measurable data to said computing device.

10. The rehabilitation and exercise machine of claim 1, wherein said first and second foot pedals include a holster and a strap arrangement to avoid unforced movement of the feet of a user of said machine while said user's feet are on said foot pedals.

11. The rehabilitation and exercise device of claim 1, further comprising a remote control device for remotely controlling the speed of said motor of said motor and pulley assembly.

12. The rehabilitation and exercise machine of claim 1, further comprising a stoppage mechanism for stopping the motor of said motor and pulley assembly.

13. The rehabilitation and exercise machine of claim 1, wherein said first and second moveable handle bars include handgrips.

14. The rehabilitation and exercise machine of claim 13, wherein said micro-control unit is operatively connected to said motor of said motor and pulley assembly, said flywheel, and said handgrips via a plurality of sensors.

15. The rehabilitation and exercise machine of claim 14, wherein said plurality of sensors includes means for transmitting a plurality of electrical signals to said micro-control unit, wherein said micro-control unit includes means for converting said plurality of electrical signals into computer measurable data.

16. The rehabilitation and exercise machine of claim 15, further comprising a computing device, wherein said micro-control unit is connected to said computing device, and wherein said plurality of sensors includes means for transmitting said plurality of electrical signals to said micro-control unit, wherein said micro-control unit includes means for converting said plurality of electrical signals into computer measurable data and further for transmitting said data to said computing device.

17. The rehabilitation and exercise machine of claim 16, wherein said computing device further includes a program for decoding said computer measurable data.

18. The rehabilitation and exercise machine of claim 17, wherein said computing device further includes a program for converting data decoded by said program for decoding said computer measurable data into a plurality of electrical control signals.

19. The rehabilitation and exercise machine of claim 18, wherein said computing device further includes means for transmitting to said micro-control unit said plurality of electrical control signals converted from said decoded data.

20. The rehabilitation and exercise machine of claim 15, wherein said micro-control unit further includes a programmable processor.

21. The rehabilitation and exercise machine of claim 20, wherein said programmable processor includes a program for decoding said computer measurable data.

22. The rehabilitation and exercise machine of claim 21, wherein said programmable processor further includes a program for converting data decoded by said program for decoding said computer measurable data into a plurality of electrical control signals.

* * * * *